United States Patent [19]

Belch

[11] Patent Number: 4,618,858

[45] Date of Patent: Oct. 21, 1986

[54] INFORMATION DISPLAY SYSTEM HAVING A MULTIPLE CELL RASTER SCAN DISPLAY

[75] Inventor: Francis R. Belch, Sale, England

[73] Assignee: Ferranti plc, Cheshire, England

[21] Appl. No.: 548,434

[22] Filed: Nov. 3, 1983

[30] Foreign Application Priority Data

Nov. 3, 1982 [GB] United Kingdom ..... 8231415

[51] Int. Cl.[4] ..... G09G 1/14

[52] U.S. Cl. ..... 340/724; 340/721; 340/723; 340/799

[58] Field of Search ..... 340/721, 724, 726, 792, 340/799

[56] References Cited

U.S. PATENT DOCUMENTS

| | | | |
|---|---|---|---|
| 4,016,362 | 4/1977 | Bristow et al. | 340/724 |
| 4,197,590 | 4/1980 | Sukonick et al. | 340/721 |
| 4,437,093 | 3/1984 | Bradley | 340/724 |
| 4,484,192 | 11/1984 | Seitz et al. | 340/721 |
| 4,533,910 | 8/1985 | Sukonick et al. | 340/721 |

*Primary Examiner*—Gerald L. Brigance

*Attorney, Agent, or Firm*—Kerkam, Stowell, Kondracki & Clarke

[57] ABSTRACT

An information display system includes a raster-scan display screen DS and an information store IS for storing information to be displayed on the screen. The store has a capacity greater than the maximum amount of information which may be displayed at any one time. Display controller DC is operable to generate a succession of screen addresses of successive areas of the display screen DS, and mapping memory MU is provided to translate each screen address into a store address indicating the location in the information store IS of the information to be displayed in that area of the display screen. Display logic DL is provided to produce from the store output the necessary signals for activating the display. Map changes MC are provided to enable the translations effected by the mapping memory MU to be varied as required to change the display. One or more input devices ID allow information to be written into the display store.

6 Claims, 7 Drawing Figures

INFORMATION DISPLAY SYSTEM HAVING A MULTIPLE CELL RASTER SCAN DISPLAY

INFORMATION DISPLAY SYSTEM

This invention relates to information display systems, in particular to systems using a raster scan display to display a variable mosaic of information derived from a number of separate information items.

Information display systems are known in which an associated store or memory contains more information than may be displayed at any one time. Thus it is possible to display whole or part pages of text or drawings, positioned as required on the screen, and to vary the position of any displayed item at will. What is necessary, however, in order to effect this, is to change the position of the stored information, since a particular part of the store is made to correspond to the area of the display. It is therefore necessary to move stored information rapidly from one position to another as the display is varied.

Display systems are known, as from U.S. Pat. No. 4,197,590 for example, which enable a splitscreen display to be used to display, for example, graphics and alphanumeric menus, or normal and enlarged views of the same picture.

It is frequently desirable to be able to produce a display which is a mosaic of a number of information items. For example several separate pages of text, or part-pages may be required to be displayed on the same screen, and the pages changed. Here again, this may be done by writing the information to be displayed from a main store into a display buffer, and changing the contents of the buffer as the display is required to change.

It is an object of the invention to provide an information display system using a raster scan display and capable of displaying a mosaic of information derived from a number of separate stored information items, in which the display may be varied at will without the need to move the stored information.

According to the present invention there is provided an information display system which includes a raster scan display screen, an information store in which may be stored information to be displayed and having a storage capacity greater than the maximum amount of information which may be displayed on the screen at any instant, display control means operable to generate a succession of screen addresses of successive areas of the display screen, mapping means responsive to the screen addresses to translate each address into a store address indicating the location in the information store of the information to be displayed in the area of the display screen, display logic responsive to the store outputs to produce the necessary signals for activating the display, and map change means for varying the translations effected by the mapping means on any desired screen address.

Preferably the mapping means comprise a random access memory.

The invention will now be described with reference to the accompanying drawings, in which.

Figure 1:
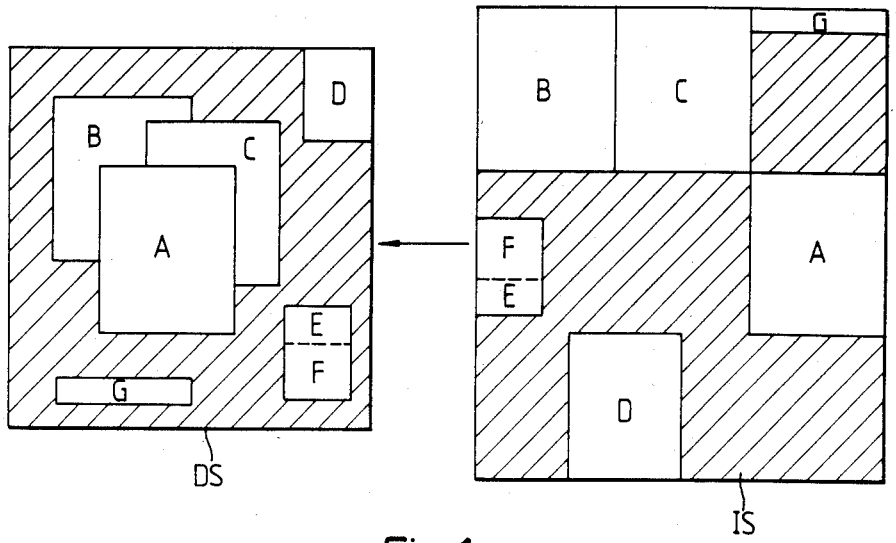
FIG. 1 illustrates the type of information display with which the invention is concerned.

Referring now to FIG. 1, this shows an information store IS in which are stored a number of "pages" of display material, say text or drawings. Each of these is indicated by a letter, and is stored at some suitable location in the store. Unused areas of the store are shown shaded. The display screen DS is arranged to display the stored information in a particular manner, different from that in which the information is stored. It will be seen, for example that "pages" A, B and C are displayed in an overlapping arrangement. Similarly the bottom E and top F of a page in the store may be shown inverted. This illustrates some of the possible variations in display. Clearly, to allow for the pages to be moved about the display screen it is necessary to access different addresses in the store.

Figure 2:
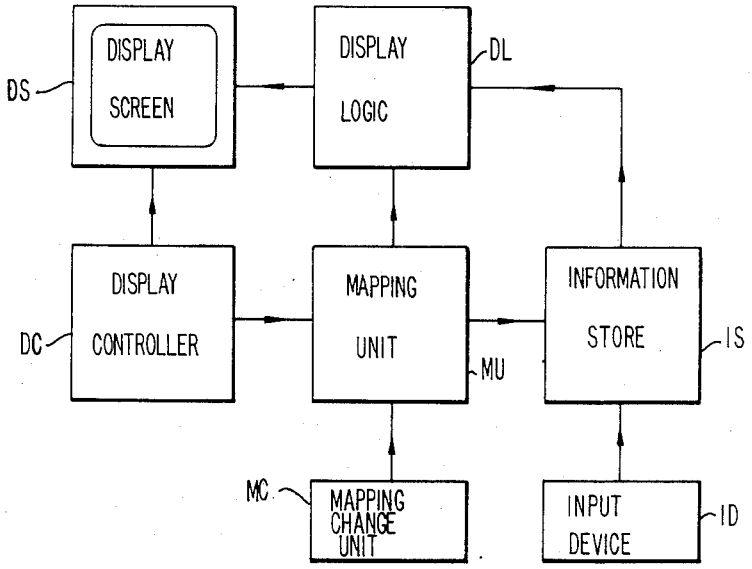
FIG. 2 is a schematic block diagram of the invention.

FIG. 2 is a block schematic diagram of the display system according to the invention. The display screen DS produces a display under the control of the display controller DC. This produces a succession of display addresses each defining an area of the display screen, and these addresses are translated by the mapping unit MU into the locations in the information store IS of the appropriate information. The store output passes to display logic DL which produces the necessary video signals for the display screen DS.

Map changing unit MC enables the display to be changed by changing the translations effected by the mapping unit MU, whilst one or more input devices ID allow information to be written into the information store.

The display screen area is considered to be divided up into a number of picture elements or "pixels", and a common size of screen has 768 of these pixels in each of 1024 lines. Since a pixel is a very small size, the screen may conveniently be considered as divided up into rather larger areas or "cells" containing for example 32 pixels in each of 32 lines. The screen may therefore be regarded as divided into 768 cells. Information is transferred from the store to the display in cells of this size, which therefore represents, in most instances, the smallest increment of movement possible when varying the display.

Figure 3:
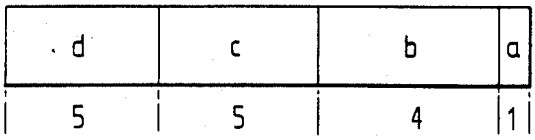
FIG. 3 shows the form of an address from the display control means.

The display controller of FIG. 2 is arranged to produce, each time that the display is to be rewritten, a succession of words, each relating to a particular part of the display. These words define the address of the part of the display in question, and FIG. 3 shows the composition of each 16-bit word, defining the address of 16 pixels of the display. The word consists of four elements. A single bit 'a' defines one of two words in a line of the cell, the position of the cell along the lines being defined by the next four more significant bits 'b'. Hence for the first cell in the raster scan, that is the top left-hand cell of the display screen, the elements 'a' and 'b' will be all zeros. For the second word along the line, 'a' will change to a one. The next word in sequence displays the next cell, and hence 'b' will be 0001, whilst 'a' changes from 0 to 1 for the second word of that cell, and so on.

In a similar way, the other two elements of the word define the line address of that word. Element 'c' comprises five bits defining the position of the line within a cell, whilst the final element 'd' defines the position of the cell itself.

It will be seen that the mapping unit is required to translate only elements 'b' and 'd', since it is the position of the cell as a whole which is translated. Once the position of that cell relative to the information store has been defined, then the individual pixels within the cell are defined by the original values of elements 'a' and 'c'.

Figure 4:
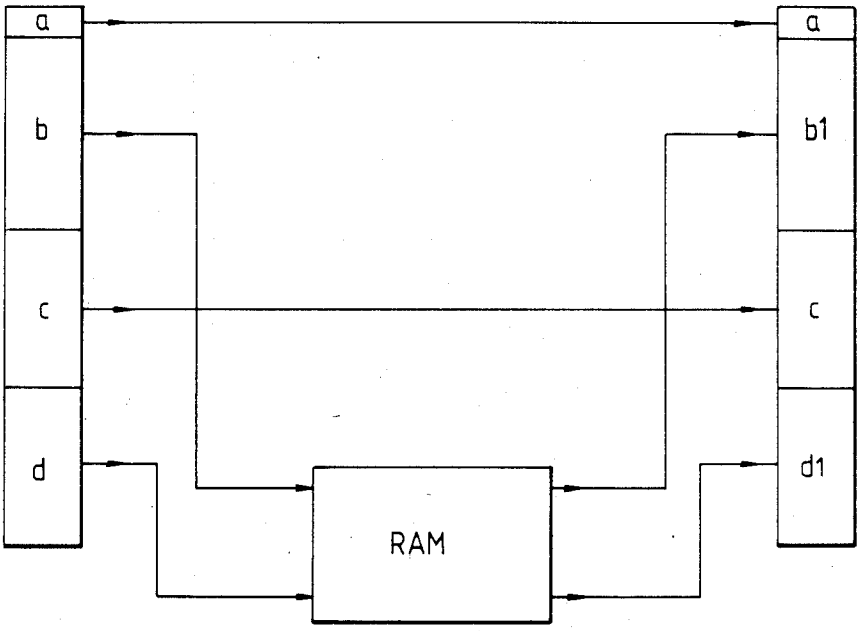
FIG. 4 illustrates the operation of the mapping means according to one embodiment of the invention.

FIG. 4 shows, in block schematic form, the necessary features of the mapping unit. This comprises, in its simplest form, a random-access memory RAM acting as a look-up table, to which elements 'b' and 'd' of each word are applied for translation into elements "b1" and "d1".

The look-up table in the mapping unit may also contain extra bits for each store address to define particular characteristics of the information to be displayed. These may include, for example, normal or inverted video, flashing or highlighted features, borders around pages or part pages of display, and so on. This information is passed directly to the display logic as shown in FIG. 2, to be associated with the relevant information read out from the store.

Figure 5:
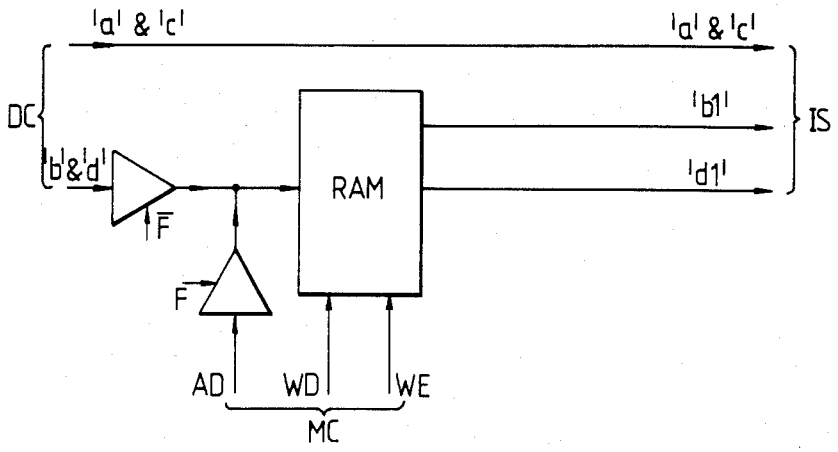
FIG. 5 is a block schematic diagram of one form of the mapping means.

FIG. 5 shows how the mapping unit may be implemented in hardware. Display address bits 'a', 'b', 'c' and 'd' are received from the display controller, and store address bits 'a', 'b1', 'c' and 'd1' are passed to the information store. The mapping unit memory RAM has its normal address input inhibited during the frame fly-back period F, and addresses AD from the mapping change unit MC of FIG. 2 are applied, together with "write" and "enable" inputs WD and WE. The unit MC will usually be a microprocessor to give the required speed of operation. The unit MC also applies an "write enable" input WE and the necessary data input WD representing the change to be effected at that address in the memory RAM. This allows the look-up table to be changed during each frame fly-back period.

Figure 6:
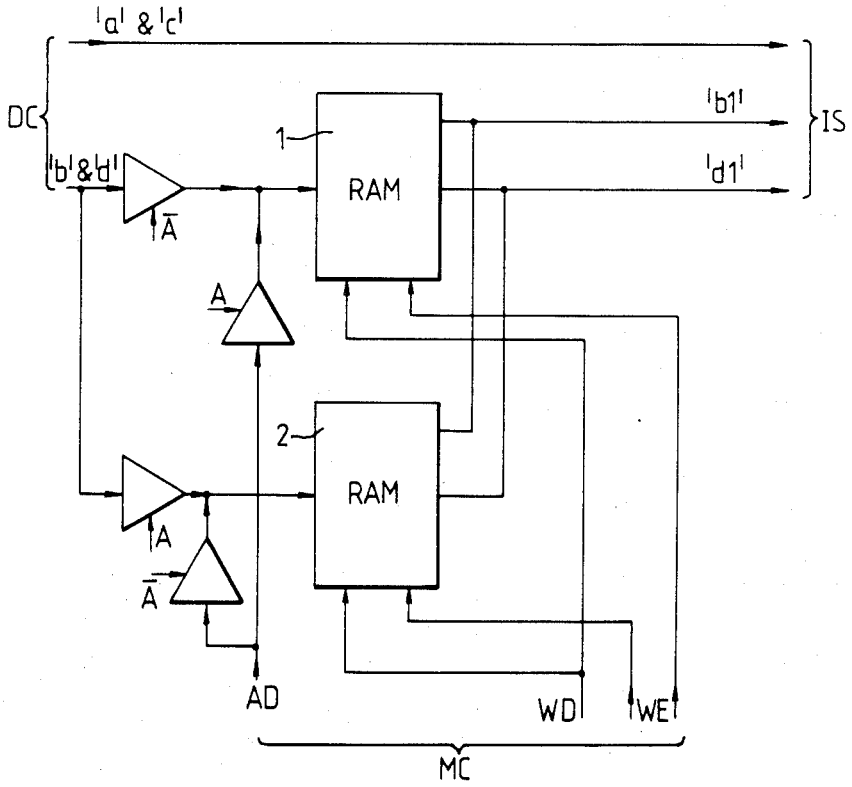
FIG. 6 is a block schematic diagram of an alternative form of the mapping means.

If the frame fly-back period is too short to enable changes to be effected, then a duplicate look-up table may be used as shown in FIG. 6. The arrangement is similar to that of FIG. 5, but allows one look-up table to be used whilst the other is being changed.

Figure 7:
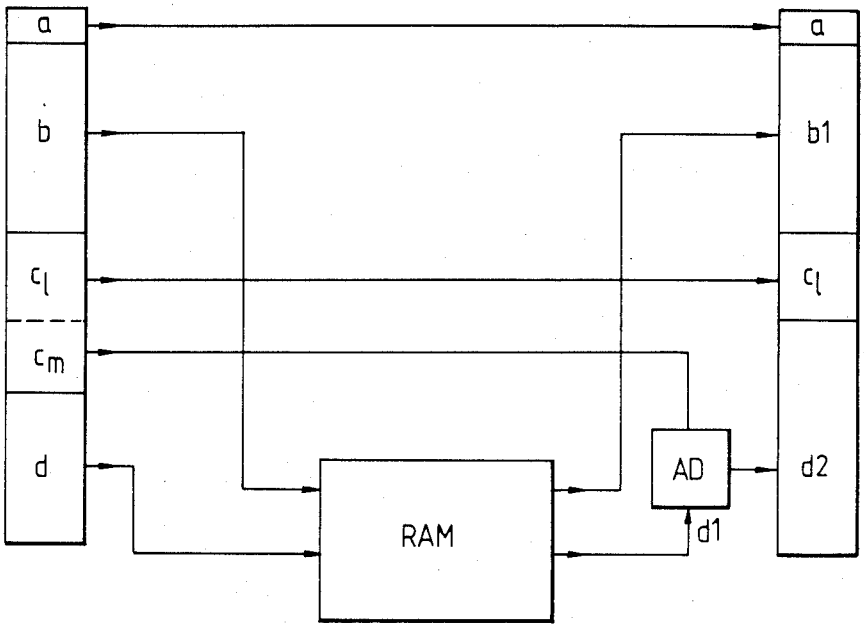
FIG. 7 illustrates the operation of the mapping means according to a second embodiment of the invention.

As has already been stated, the position of displayed information on the screen may be changed in increments of one display cell. In some instances this may represent a fairly large positional change, and this applies particularly when "scrolling" some of the displayed information. Vertical shifting of 32 lines at a time could represent a sudden shift of two or more lines of characters on the screen. FIG. 7 shows how a more gradual shift may be introduced. This involves changing the configuration of the elements 'c' and 1' of the store address provided by the look-up table. Element 'c' is split into two parts, '$c_m$' being the most significant bits and '$c_l$' being the least significant bits. The desired line increment has to be predetermined; if for example the increment is to be two lines, then '$c_l$' will be a single bit of the element 'c'. The least (or less) significant bits '$c_l$' pass directly from the display controller to the store as before, as does the element 'a'. Elements 'b' and 'd' pass to the look-up table as before. However, the look-up table has to be changed to include an extra four "line offset" bits in the element 'd1', which will therefore consist of nine bits. These nine bits from the look-up table pass to an adder where they are added to the four most significant bits of 'c', namely '$c_m$'. The resulting nine bits, now designated 'd2', pass to the store. Element 'b' is translated to 'b1' exactly as before. For scrolling to occur, the look-up table has to be changed to alter the line offset bits of 'd1' each time scrolling is required.

If an area or areas of the display are required to be blank, then each cell in such areas may be given the same store address by the display controller. That particular address in the store contains information defining the required display in those areas.

The main pixel store may comprise one or more planes, depending upon the complexity of the display. For a simple black and white display a single plane will be sufficient. However, if grey scale or colour displays are required, a multiple plane store will be necessary. Each store address relates to all planes, and hence a number of bits of information will be read out in parallel, and are subsequently arranged in serial form for application to the display logic.

The display screen may be larger or smaller horizontal and vertical resolution than that discussed above. In such cases the number of address bits would also be different.

The display screen and store need not be divided up into cells as discussed above; the cells may be smaller or larger in size than that suggested. This would allow smaller or larger increments of movement of parts of the display relative to one another. However, it would then be necessary to pass more, or less, of the address bits generated by the display controller through the look-up table.

What I claim is:

1. An information display system capable of displaying a variable mosaic of information derived from a number of separate information items, comprising a raster scan display having a display screen, said display screen being divided into a number of cells, each cell representing a separate area of the display screen and each cell having an unique screen address; an information store comprising a plurality of storage elements and having a storage capacity for display information greater than the maximum amount of information which may be displayed on the screen at any instant and capable of storing a number of separate information items; display control means for generating the screen addresses of successive cells of the display screen; mapping means including a look-up table in the form of a random access memory containing the address of each individual storage element in the information store and responsive to the screen addresses for translating each individual screen address individually into a store address indicating the location in the information store of the information to be displayed in the cell of the display screen corresponding to the individual screen address such that each separate cell of the display may display information from any selected information item; display logic means responsive to the outputs from each successive location in the information store and operatively connected to the display to produce the necessary signals for activating the display; and map changing means connected to the mapping means for varying the translations effected by the mapping means on any desired screen address by changing the contents of said look-up table.

2. A system as claimed in claim 1 in which the map changing means comprise means for changing the contents of the mapping means during the frame flyback period of the raster scan display.

3. A system as claimed in claim 1 in which the mapping means comprise two random access memories, one only of said random access memories being operable at any instant.

4. A system as claimed in claim 3 in which the map changing means comprise means for changing the contents of one of said random access memories whilst the other random access memory is operable.

5. A system as claimed in claim 1 in which the random access memory has a storage location for each screen address, and wherein each storage location may contain additional information defining characteristics of the display of the information identified by the address in said storage location.

6. A system as claimed in claim 1 in which the information store is a multiple-plane store.

* * * * *